United States Patent [19]

Mallek et al.

[11] Patent Number: 4,544,374

[45] Date of Patent: Oct. 1, 1985

[54] APPARATUS FOR BURNING ORGANIC MATERIALS

[75] Inventors: Heinz Mallek, Linnich-Tetz; Manfred Laser, Jülich-Koslar; Dorothee Ermisch, Essen, all of Fed. Rep. of Germany

[73] Assignee: Kernforschungsanlage Jülich GmbH, Jülich, Fed. Rep. of Germany

[21] Appl. No.: 540,902

[22] Filed: Oct. 11, 1983

Related U.S. Application Data

[62] Division of Ser. No. 331,197, Dec. 16, 1981, abandoned.

[30] Foreign Application Priority Data

Dec. 27, 1980 [DE] Fed. Rep. of Germany ..... 3049250

[51] Int. Cl.[4] ..... C10J 3/20

[52] U.S. Cl. ..... 48/114; 110/226; 110/227; 110/229; 110/230

[58] Field of Search ..... 48/209, 111; 110/346, 110/226, 227, 229, 230, 255, 259, 251, 248

[56] References Cited

U.S. PATENT DOCUMENTS

| | | | |
|---|---|---|---|
| 2,579,398 | 12/1951 | Roetheli | 48/202 |
| 4,028,068 | 6/1977 | Kiener | 48/209 |
| 4,116,136 | 9/1978 | Mallek et al. | 110/251 |
| 4,262,611 | 4/1981 | Kuhnert et al. | 110/346 |

FOREIGN PATENT DOCUMENTS

| | | | |
|---|---|---|---|
| 1029174 | 5/1963 | United Kingdom | 110/226 |

*Primary Examiner*—Peter Kratz

*Attorney, Agent, or Firm*—Frishauf, Holtz, Goodman & Woodward

[57] ABSTRACT

Separation of the apparatus for drying and degassing organic waste from the shaft furnace containing a gasification chamber and a combustion chamber increases the through-put capability of the shaft furnace gasification. The gasification is promoted by the addition, in the same direction of flow as the partly carbonized waste material, of a gas such as air, steam, carbon dioxide or oxygen adjusted in accordance with the changes in composition of the material that is gasified. The drying and degassing chamber is a rotary drum feeding the dried and degassed material into the top of the shaft furnace. An intermediate chamber may be imposed between the rotary drum and the shaft furnace at the top of the shaft furnace so that a sieve can separate incombustible material such as metal parts for withdrawal through a gas-tight sluice. A narrow gap, either a straight gap between moveable members or an annular gap defined by a rotary plug, provides the communication between the gasification chamber and the combustion chamber below. Material is held above the gap for completion of gasification and the actual combustion with additional air supply takes place in the combustion chamber.

1 Claim, 2 Drawing Figures

APPARATUS FOR BURNING ORGANIC MATERIALS

This application is a division of application Ser. No. 331,197, filed Dec. 16, 1981, and now abandoned.

This invention concerns a process for burning waste consisting of organic substances in which the waste is first heated with exclusion of air up to about 550° C. and thereby dried and degassed and thereafter is heated in a continuing flow of material at temperatures up to about 850° C. for gasification of a predominaant portion thereof, after which the gases thereby formed are in whole or in part brought into a combustion chamber with the residual combustible solid products and the ashes formed upon gasification, with addition of fresh air for producing combustion. The invention also concerns apparatus for carrying out the process.

Processes and installations for burning organic waste material, i.e. particularly solid waste with occasional liquid components, are well known in the art. For example, there is known from U.S. Pat. No. 4,116,136 and from German patent publication No. 2,654,041 a process of the above-mentioned kind in which the waste materials are first dried, then degassed and then gasified and the gaseous and solid products thus pretreated are then burned. In this case drying, degassing, gasification and combustion processes run continuously. In order to obtain an extensive gasification of the waste materials a bed of lowing carbon("live coals") is produced with the gaseous products reaching the gasification chamber. For this purpose air is introduced in sufficient quantity into the gasification zone to enable the owing carbon bed to have a sufficiently high temperature and a sufficiently extensive volume for the intended purpose. It has been found, however, that in the use of such a shaft furnace, a certain cross sectional dimension must not be exceeded, because on account of the poor heat conductivity of the waste, with larger diameters it is no longer possible to supply at an even rate the necessary energy for drying, degassing and gasification. Both in the case of indirect heat supply from the furnace walls inwards and in the case of direct heat supply by partial burning of the gases formed upon gasification, the further disadvantage consequence has arisen when the cross sectional dimension is excessive that reaction channels are formed and reaction concentrations occur at the periphery. The running of the process thereby becomes uncontrollable. If a shaft furnace of the above-mentioned type is used for burning waste, the throughput may not be raised above one ton per hour if the process is to run smoothly.

THE INVENTION

It is an object of the present invention to provide a process and an apparatus for its performance by which it is possible to manage effectively throughputs of waste materials in a gasification and combustion furnace that are greater than those available with the known furnaces ahd processes.

Briefly, the drying and degassing on the one hand and the gasification, on the other hand, of the waste material are carried out in two separate steps that are distinct from a handling point of view. In a first step the material is dried and degassed, in a second step the resulting material is gasified, and in the material transfer therebetween the materials are so guided and propelled that the material flow between the two steps is interruptible for purposes of mechanical handling of the material resulting from degassing. Furthermore, at the beginning of the gasification phase a gasification-promoting gas such as air, steam, $CO_2$ and/or $O_2$ is supplied for the gasification of the degassed material in quantities corresponding to the observed changes in the composition of the material during its progress through the furnace.

The gasification-promoting gas or gasses are introduced so that from the beginning and during the gasification reaction they proceed through the furnace in the same direction of movement as the solids. By the separation of the drying and degassing step from the gasification step the result is obtained that the gasification is controllable and manageable to a much greater extent than heretofore, because the addition of gasification-promoting gases is easily variable in accordance with the composition of the gases produced by gasification and that of the solid combustible materials.

It is highly advantageous to perform the process according to the invention in such a way that the gasification-promoting gas flows together with the material to be gasified in the direction of movement of that material, along with the gases formed by drying and degassing. In that way the steam liberated by drying with the formation of water gas is led over the coke formed by degasification for gasification of carbon, and likewise the low-temperature carbonization gases rising from the waste are led for cracking of the long chain hydrocarbon molecules into smaller molecular components at the gasification temperature. In this manner, it is possible to convert waste into a high-value fuel gas to an extent that is not insignificant, which leads to a raising of the effectiveness of the combustion of the waste material. It is also of great advantage that the fuel gas developed by gasification is removed through a slot-shaped exit, so that the material above the gap is held for completion of its gasification. It is useful to carry out the process of the invention in such a way that incombustible components, such as metal bodies that are bound up in the organic waste material are removed after degassing from the flow of material intended to be treated further. This also leads to better control of the reactions during gasification.

A preferred apparatus for carrying out the process according to the invention is an installation including a shaft furnace for carrying out a first embodiment of the process equipped with means for providing gasification heat to the material in the shaft and with a combustion chamber connected downstream of the shaft equipped with burners and fresh air inlets discharging thereinto and having at the floor of the combustion chamber provisions for ash removal.

The installation including a shaft furnace is equipped in accordance with the invention with a first chamber serving for pre-treatment of the organic waste material by heating under exclusion of air to temperatures up to about 550° C. which precedes the furnace shaft that constitutes the second chamber further downstream that serves for heating the materials at higher temperatures. In the upper portion of the shaft, in the gasification chamber, an inlet for the gasification-promoting gas to be added to the material to be gasified has its discharge. The shaft is separated at its bottom from the combustion chamber by a restricted exit of narrowed cross-section defined by structural components controlling the passage of the material to be burned. It is advantageous to constitute the passage as a ring-gap or straight-sided slot.

The use of a shaft furnace for the disposition of waste equipped with a combustion chamber in the furnace is known, for example, from U.S. Pat. No. 4,116,136. In this known shaft furnace, fresh air supply ducts are provided for the combustion chamber and likewise smoke gas removal ducts. Furthermore, at the transition from the shaft of the shaft furnace to the combustion chamber a constriction is provided in the immediate neighborhood of which the fresh air inlets to the combustion chambers have their orifices. In this known shaft furnace, the waste to be disposed of is dried, degassed, gasified and then the still remaining coke residues are burned together with the fuel gas that is produced.

In contrast with the above-mentioned device, in the installation according to the invention, a heated pretreatment chamber is provided upstream of the shaft furnace in which the gasification and combustion is carried out. The organic materials are dried and degassed in the pretreatment chamber.

A convenient further development of the installation including a shaft furnace consists in the connection of exhaust gas channels to the shaft which, in their course to a discharge such as a smoke stack, run around the outside of the walls of the first chamber.

A particularly advantageous embodiment of the installation containing a shaft furnace according to the invention is provided when the first chamber provided for drying and degassing is constituted as a rotary drum with its axis inclined to the horizontal and equipped with a gas-tight sluice system at its input end for exclusion of air and having its lower end disposed for discharge into the upper part of the gasification chamber, so that the material subjected to heat treatment is put into the furnace shaft after being propelled out of the rotary drum.

In the 1977 volume of the periodical "Müll und Abfall", at pp. 293 to 300, the use of a steel rotary drum for pyrolysis of organic waste material is disclosed (compare particularly Table 2 and also the lefthand column of page 296). This rotary drum is indirectly heated with the exhaust heat of a gas motor or the discharge gases of a gas or oil burner. On both sides of the rotary drum, gas-tight sluice systems are provided; they make possible a continuous loading and a continuous removal of slag and soot. The tubular structures built into this device provide, along with the supply of heat, the turning over of material and simultaneously the transport of material. Burning of the residual solid materials and of a part of the gases produced is not provided. Consequently, this apparatus is also usable only within a limited scope. In contrast, in the case of the apparatus according to the present invention, in a continuously running process, drying and degassing of the organic waste materials is separated fromthe gasification and the following combustion. This takes place because the drying and degassing under exclusion of air is performed in the externally heated rotary drum, and the gasification with addition with gasification-promoting gases takes place in the shaft furnace. By the separation of the drying and degassing operation from the gasification and succeeding combustion operations, the result is obtained that the operations are more easily controllable and in the gasification stage a fuel gas is generated that is uniform in its quality and leads to a complete combustion of the waste material.

It has been found that the combustion capacity is raised by the installation according to the invention. If in the case of an installation according to the invention, a shaft furnace of the same size as heretofore used is employed, this leads to a five-fold increase of the treatment capacity. This is because the substantial volume reduction takes place in the rotary drum.

It is further advantageous that the dominant coke is supplied to the shaft furnace, as the result of which a loose layer is produced that is much more permeable compared to normal refuse, so that the gasification-promoting gas added in concurrent flow at the input of the shaft furnace is fully effective in the gasification that takes place in the shaft. Consequently, the gasification operation runs much more evenly and completely than was the case in the apparatus heretofore known.

A very important further advantage is found with respect to the materials used in the construction of the apparatus according to the invention. By the separation of the drying and degassing zone from the gasification zone and the combustion zone, two different temperature-regions are provided. In the drying and degassing zone, i.e., in the rotary drum, there are temperatures up to a maximum of 550° C. The temperatures in the gasification zone are at around 850° C. Accordingly, only the gasification zone and the combustion zone connected to it need to be constructed of materials resistant to high temperatues. Materials of lower temperature resistance are sufficient forthe rotary drum.

In order to secure a transition between rotary drum and shaft furnace that is as simple as possible, it is convenient to constitute the installation according to the invention in such a way that an intermediate chamber is provided between the end of the rotary drum at which is propelled the dried and degassed material ready for further treatment and the shaft. This intermediate chamber extends over and somewhat around the top of the shaft furnace and is equipped with one or more gas-tight sluices.

In order to make it possible to remove foreign bodies from the organic waste materials, such as metal pieces or the like, from the flow of material proceeding from the degassing stage towards further treatment, and prevents these foreign bodies from being propelled in an uncontrolled way into the gasification zone, it is advantageous to provide for a shakeable sieve to cover entirely or in part the upper portion of the shaft and to provide a side shaft connecting with the intermediate chamber at a place opposite the exit from the rotary drum, the auxiliary shaft having its lower surface connecting with the intermediate chamber at the height of the sieve and being equipped with a gas-tight sluice for removal of incombustible material.

In order that a space of sufficient volume should be available, above the ash pit a closure flap device is provided with sufficient spacing from the constriction in the shaft of the shaft furnace.

BRIEF DESCRIPTION OF THE DRAWINGS

The invention is further described by way of illustrative example with reference to the annexed drawings, in which.

DESCRIPTION OF THE ILLUSTRATED EMBODIMENTS

Figure 1:
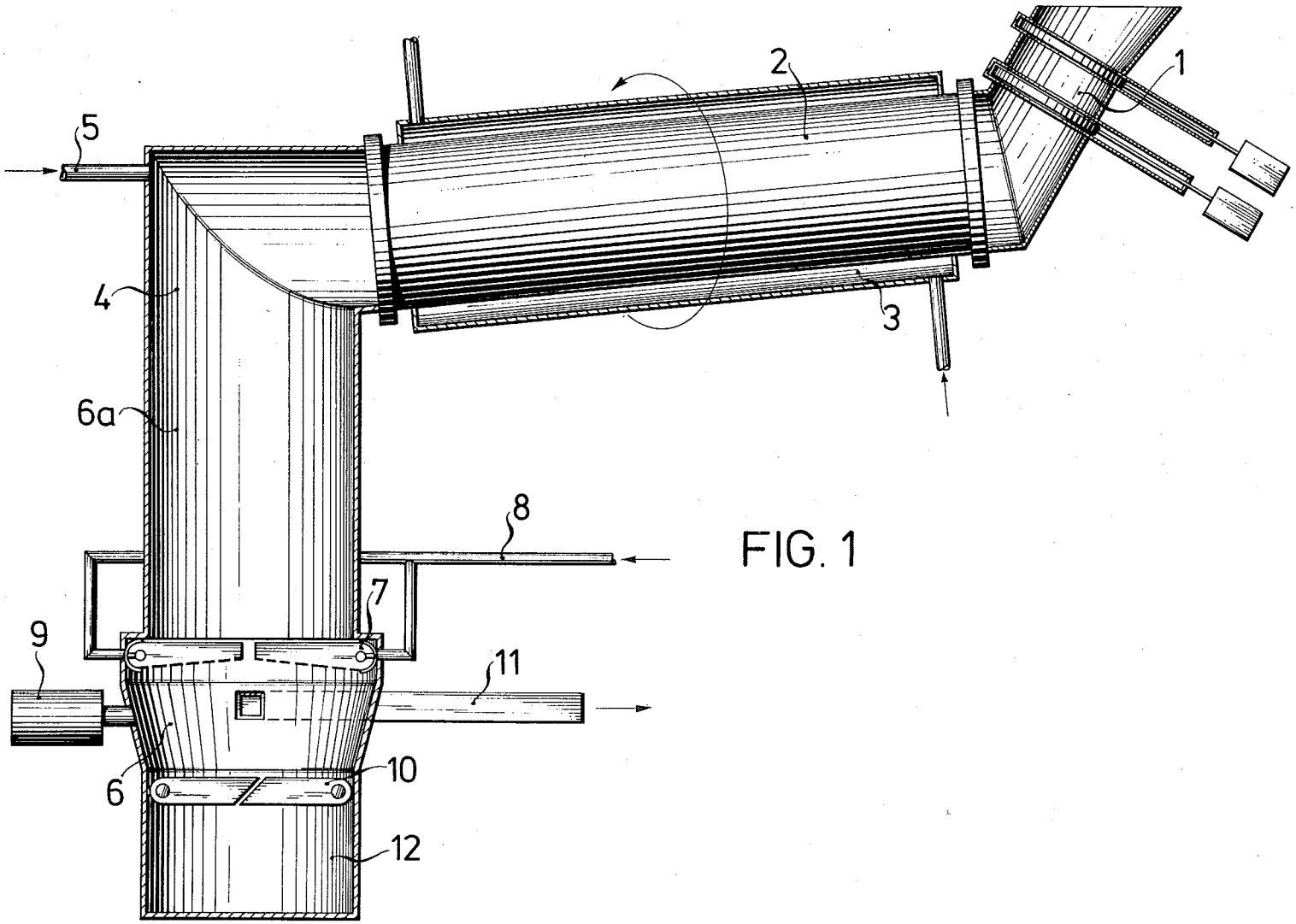
FIG. 1 is a schematic cross-section of the construction of a first embodiment for burning organic waste in accordance with the invention.

As shown in FIG. 1, the waste material is introduced into the rotary drum 2 through the filling sluice 1. The rotary drum 2 is an elongated drum with its axis inclined to the horizontal. The waste material is heated in the drum 2 up to about 550° C. and thereby dried and degassed. For this purpose, the rotary drum 2 itself must be heated. This can be done either directly by the disposition of burners (see 8 in FIG. 2) or conveniently indirectly by leading the smoke gas line 11 connected to the combustion chamber 6 in the lower part of the shaft furnace 4 to run in such a way that the duct path 3 surrounds the rotary drum 2, with the external wall of the drum 2 constituting at the same time an interior wall of the jacket 3 that is a part of the smoke gas discharge line 11.

At its lower end the rotary drum 2 is so connected with the upper part of the shaft furnace 4 that the material filled into the rotary drum 2 is propelled into the shaft of the shaft furnace 4 after drying and degassing. The shaft of the shaft furnace 4 forms the gasification chamber 6*a*. In the upper part of the gasification chamber 6*a*, there discharges a supply line 5 for the added gasification-promoting gas. The gasification chamber 6*a* is, as is evident from FIG. 1, separated from the following combustion chamber 6 by one or more sluice elements 7. The sluice elements 7 have a closed upper side facing the gasification chamber and are mounted on a rotatable shaft or axis which, by its movement, can clear or more or less block the slot-shaped passage for the transport of the solid and gaseous products out of the gasification chamber 6*a* into the combustion chamber 6. Below the sluice elements 7 there open out into the combustion chamber the combustion-supporting air inlets 8. Furthermore, one or more burners 9 are arranged around the combustion chamber 6, of which only one is shown in the drawing.

The smoke gases produced in combustion are led away by the smoke gas line 11 already mentioned, which is connected to the combustion chamber. The solid components reaching the combustion chamber 6 deposit themselves in a layer on the closure flaps 10 that form the floor of the combustion chamber. The closure flap device is located at a spacing relative to the sluice elements 7 that assures a sufficient volume for the combustion chamber. The arrangement of a closure flap device 10 in the combustion chamber 6 has the advantage that further propelling towards the ash pit 12, without leaving residues behind, is facilitated for the ashes formed in combustion that may collect from time to time.

Figure 2:
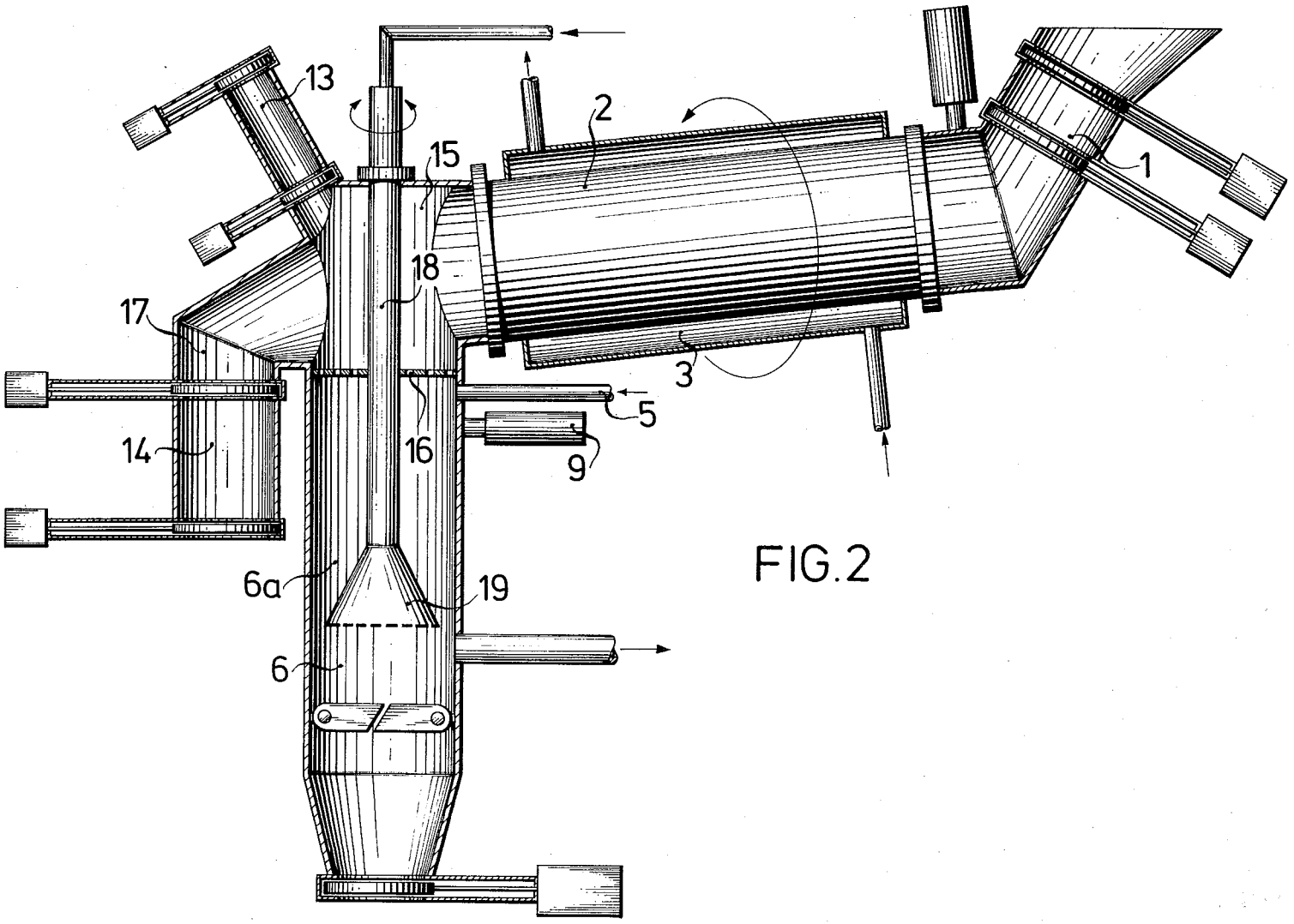
FIG. 2 is a schematic cross-section of a second embodiment of furnace for burning of organic waste in accordance with the invention.

In the illustrative embodiment according to the invention shown in FIG. 2, the end of the rotary drum 2 from which the material charged into the drum is propelled further after drying and degassing does not lead directly into the shaft of the shaft furnace 4, but rather into an intermediate chamber 15 located between rotary drum and shaft furnace and equipped with gas-tight sluices 13 and 14. The intermediate chamber 15 hooks over the upper portion of the shaft of the shaft furnace 4. The shaft is covered by a shake-sieve 6. That has the advantage that only gaseous products and such solid products as can fall through the meshes of the shake-sieve may get into the shaft and thus into the combustion chamber 6*a*, into the upper part of which the inlet 5 for the gasification-promoting gas to be added discharges. The solid material that gets into the shaft is essentially the coked material produced by degassing. The incoebustible remaining waste components, as for example metal bodies, proceed over the shake-sieve 16 across the top of the shaft into an auxiliary shaft 17 connected to the intermediate chamber 15 and equipped with a gas-tight sluice 14. Additives that may be necessary for converting or fixing noxious materials that are formed by heat treatment of waste can, in the case of this embodiment, be introduced through the sluice 13 provided for the intermediate chamber 15.

In the embodiment reproduced in FIG. 2, the member 18 formed in tubular shape and rotatable about its longitudinal axis is provided in the shaft of the shaft furnace 4 and is equipped with a conically widening part 19 at its end extending into the shaft. A constriction is thereby produced between the base of the conically shaped part 19 and the neighboring wall of the furnace shaft in the form of an annular gap forming the only communication between the gasification chamber 6*a* and the combustion chamber 6. By provision for rotating the tubular member 18 about its longitudinal axis, indicated by the arrow at the top of this member but not otherwise shown in the drawing, makes it also possible to provide stirring arms (not shown) laterally extending from the member 18 into the shaft, by which a loosening of the material to be gasified can be produced during gasification. The tubular shaped member 18 in this embodiment also serves at the same time for supply of air into the combustion chamber.

Although the invention has been described with reference to particular illustrative examples, it will be understood that still other variations and modifications than those specifically mentioned are possible within the inventive concept.

We claim:

1. Apparatus of the shaft-furnace type for burning organic waste matter, comprising in addition to a furnace shaft (4) and a combustion chamber (6) below it:

a pretreatment chamber (2) having means (3) for heating waste material contained therein, with exclusion of air, up to a temperature in the range from 400° to 550° C. constructed near the top of said shaft and disposed so as to discharge degassed waste material into a region of the interior of said shaft substantially at the top of said furnace shaft, said pretreatment chamber (2) being provided in the form of a rotary drum (2) having its axis inclined to the horizontal for gravity feed of the contents to said furnace shaft, being equipped at its input with a gas-tight sluice system (1) and arranged to discharge into a chamber extending over and somewhat around the upper part of said furnace shaft which is equipped with at least one gas-tight sluice (13, 14) for access between the interior and exterior;

means (5) for supplying a gasification-promoting gas at the top of said furnace shaft for downward passage thereof to said furnace shaft;

means (7, 19) for separating said furance shaft from said combustion chamber so as to hold organic material in said shaft for the course of a gasifying reaction and providing a narrow passage to said combustion chamber there below at least for gases and equipped wtih means for controlling the admission of material to be burned past the said separating means into said combustion chamber, said separating means situated so as to form the top of said combustion chamber and said furnace shaft being constructed so as to extend directly upward from said separating means;

a shake-sieve (16) provided in said furnace shaft, defining the bottom of said chamber at the top of the furnace shaft in which said rotary drum discharges, said shake-sieve covering at least a major part of a portion of said furnace shaft (4) above said separating means (19) said chamber at the top of said furnace shaft connecting with a side shaft (17) located opposite said rotary drum with respect to said furnace shaft and being equipped with a said gas-tight access sluice (14) for removal of incombustible material that does not pass downward through said sieve, and means (8, 9) for maintaining combusition in said combustion chamber and for thereby giving off heat to said furnace shaft in sufficient quantity for heating the contents of said furnace shaft resting on said separating means to a temperature substantially above 550° C. for gasification of a gasifiable organic material included in said contents.

* * * * *